US008727160B2

(12) United States Patent
Fuchs et al.

(10) Patent No.: US 8,727,160 B2
(45) Date of Patent: May 20, 2014

(54) CONTAINER FOR PRESSURIZED BEVERAGE

(75) Inventors: Stephen Fuchs, Attendorn (DE); Michael Schneider, Neunkirchen (DE)

(73) Assignee: Schaefer Werke GmbH, Neunkirchen (DE)

( * ) Notice: Subject to any disclaimer, the term of this patent is extended or adjusted under 35 U.S.C. 154(b) by 79 days.

(21) Appl. No.: 13/430,828

(22) Filed: Mar. 27, 2012

(65) Prior Publication Data

US 2012/0248109 A1 Oct. 4, 2012

(30) Foreign Application Priority Data

Mar. 30, 2011 (DE) ..... 10 2011 015 516

(51) Int. Cl.
*B65D 51/16* (2006.01)

(52) U.S. Cl.
USPC ..... 220/203.04; 220/89.3; 215/310; 137/68.23

(58) Field of Classification Search
USPC ..... 220/203.04, 203.07, 89.1, 203.08, 89.2, 220/89.3, 203.18, 366.1, 360; 137/68.23, 137/68.3, 68.11, 68.29; 215/310, 260, 270; 222/541.3, 5, 397
See application file for complete search history.

(56) References Cited

U.S. PATENT DOCUMENTS

| | | | | |
|---|---|---|---|---|
| 6,241,116 | B1 | 6/2001 | Schrepfer et al. | |
| 6,311,875 | B1 | 11/2001 | Anderson et al. | |
| 7,703,640 | B1 * | 4/2010 | Hollars et al. | 222/5 |
| 2007/0284371 | A1 * | 12/2007 | Anderson et al. | 220/4.12 |
| 2010/0102087 | A1 | 4/2010 | Meike | |
| 2010/0294762 | A1 * | 11/2010 | Kolon et al. | 220/89.1 |
| 2011/0280502 | A1 | 11/2011 | Meike | |

FOREIGN PATENT DOCUMENTS

| | | | |
|---|---|---|---|
| DE | 3707192 | A1 | 9/1988 |
| DE | 4041363 | A | 6/1992 |
| WO | 2005113371 | A2 | 12/2005 |

* cited by examiner

*Primary Examiner* — Jeffrey Allen
(74) *Attorney, Agent, or Firm* — Andrew Wilford

(57) ABSTRACT

A fitting used with a container holding a pressurized beverage and adapted for connection to a filling or dispensing device has an annular and outwardly projecting collar formed unitarily with the fitting and forming a passage opening into the container and a flexible burst membrane in the fitting and blocking the passage.

4 Claims, 4 Drawing Sheets

1
2
3
4
5
6
7
A
V
B

CONTAINER FOR PRESSURIZED BEVERAGE

FIELD OF THE INVENTION

The present invention relates to a beverage container. More particularly this invention concerns such a container for a pressurized beverage, for instance soda, sparkling wine, or beer and having a fitting for filling or emptying the beverage and for venting it in case of a dangerous overpressure.

BACKGROUND OF THE INVENTION

A container having a safety vent or a predetermined burst point is known from U.S. Pat. No. 6,241,116. This metal container has a hollow body accommodating the filling or the beverage and composed of an essentially cylindrical jacket and two outwardly curved end walls. At least one of the end walls has a bulge that preferably protrudes as a so-called cup-shaped bottom from the curved end wall, wherein a container connecting pipe is provided in the cup-shaped wall. At least one of the end walls is provided with a notch embodied on its outside as an intended release point that fulfills the function of an overpressure protection or an overload protection.

The overpressure protection that is known in various variants from DE 40 41 636 is intended to prevent internal pressure in the container from rising up to a very high value and burst the container in the event of incorrect treatment of the container as well as with incorrect operation or loss of function of pressure-reducing organs. Instead, at a defined pressure below the maximum bursting pressure of the container, the produced overpressure is dissipated in a safe manner by the automatic opening of the safety vent or safety release point in the container wall.

A container described in US 2011/0280502 has an internal bladder formed at its top or head end with a sleeve-like connector that can be connected to a valve or safety fitting for filling the liquid and having respective closeable passages for compressed gas and for the beverage. The containers or bladders, in particular made from PET, are used in beverage-dispensing apparatuses for $CO_2$ compressed gas-operated dispensing of beverages cooled to drinking temperature. The beverage can be removed or the container/the bladder can be filled via a tap head that can be placed on the fitting that has a beverage valve and a gas valve, mounted on the container or the bladder at the top, and is attached via an adapter ring connecting the connector of the container or of the bladder with a detent groove of the fitting from outside, or to a connection piece that can be mounted thereon. The beverage is then forced to the beverage outlet via a riser tube projecting from above down into container.

A beverage-dispensing device with a fitting mounted on the top of the liquid container is furthermore known from US 2010/0120897. To attach the fitting, the mouth of the container is formed with a flange is surrounded around by a connecting piece, for example, a metallic clamp ring or a screw-on plastic ring. The riser tube or fitting tube is there embodied as a moveable component of the seal that can be adjusted longitudinally and can be set in a number of different positions.

OBJECTS OF THE INVENTION

It is therefore an object of the present invention to provide an improved container for a pressurized beverage.

Another object is the provision of such an improved container for a pressurized beverage that overcomes the above-given disadvantages, in particular in which a safety vent with better functionality can be provided in a simpler manner.

SUMMARY OF THE INVENTION

These objects are attained with a fitting used with a container holding a pressurized beverage and adapted for connection to a filling or dispensing device. The fitting according to the invention has an annular and outwardly projecting collar formed unitarily with the fitting and forming a passage opening into the container and a flexible burst membrane in the fitting and blocking the passage.

A safety vent is thus provided that is not subject to any limitations during production, in that it is made in one piece with the fitting present anyway for filling with a beverage in a brewery or for tapping by the consumer. In contrast, the predetermined release points provided by notches in the container with a bladder of PET or plastic optionally inserted therein must be produced either by machining, such as by milling or by laser processing, or by embossing a closed or partially interrupted notch that is usually circular. However, according to the invention the burst membrane, which can be composed of different frangible or flexible materials such as ceramic or metal or a film of plastic, needs only to be inserted into the collar and to be attached covering the wall hole, e.g., by adhesion. It is easy to provide the manufacturer with an assortment of membranes set to rupture or burst at different pressures, depending on what is being packaged.

According to a preferred embodiment of the invention, a perforation element has a cylindrical forming head fitted into the collar from outside or fitted thereon. This head has a point facing toward the burst membrane and for manual unloading of the safety vent has a tab extending angularly of the center axis of the fitting from the forming head and, when lifted away from the fitting, moves the point into the burst membrane. The thus bidirectional safety vent of the fitting, e.g. a basket fitting, a flat fitting or a triangular fitting, according to the invention provides an additional function, namely, in addition to the overpressure protection or overload protection, a targeted pressure relief to be triggered manually from outside, such as in particular to ensure a completely depressurized container for the disposal thereof. By pulling the tab, the otherwise stationary point moves in the direction toward the container or the burst membrane thereof and pierces or destroys it. By means of the forming head plunging into the collar, which forming head can be held in or on the collar by clamping, welding or adhesion, the burst membrane can also be inserted loosely into the collar, optionally with interposition of a seal ring.

For easier actuation and introduction of the targeted manual pressure relief, a release lug that projects outward is molded on the tab. The tab hugging the wall of the fitting over its limited length can thus be easily gripped and pulled away by the release lug simultaneously used for pressure relief.

According to a further proposal of the invention, the tab is formed with a film hinge extending across its width in the region between the release lug and the molded head. The original condition of the safety vent can be thus be monitored, so that it forms a tamper indicator. If it has already been activated manually for pressure relief, this is immediately discernible due to the film hinge that is then broken.

BRIEF DESCRIPTION OF THE DRAWING

The above and other objects, features, and advantages will become more readily apparent from the following description, reference being made to the accompanying drawing in which.

DETAILED DESCRIPTION

Figure 1:
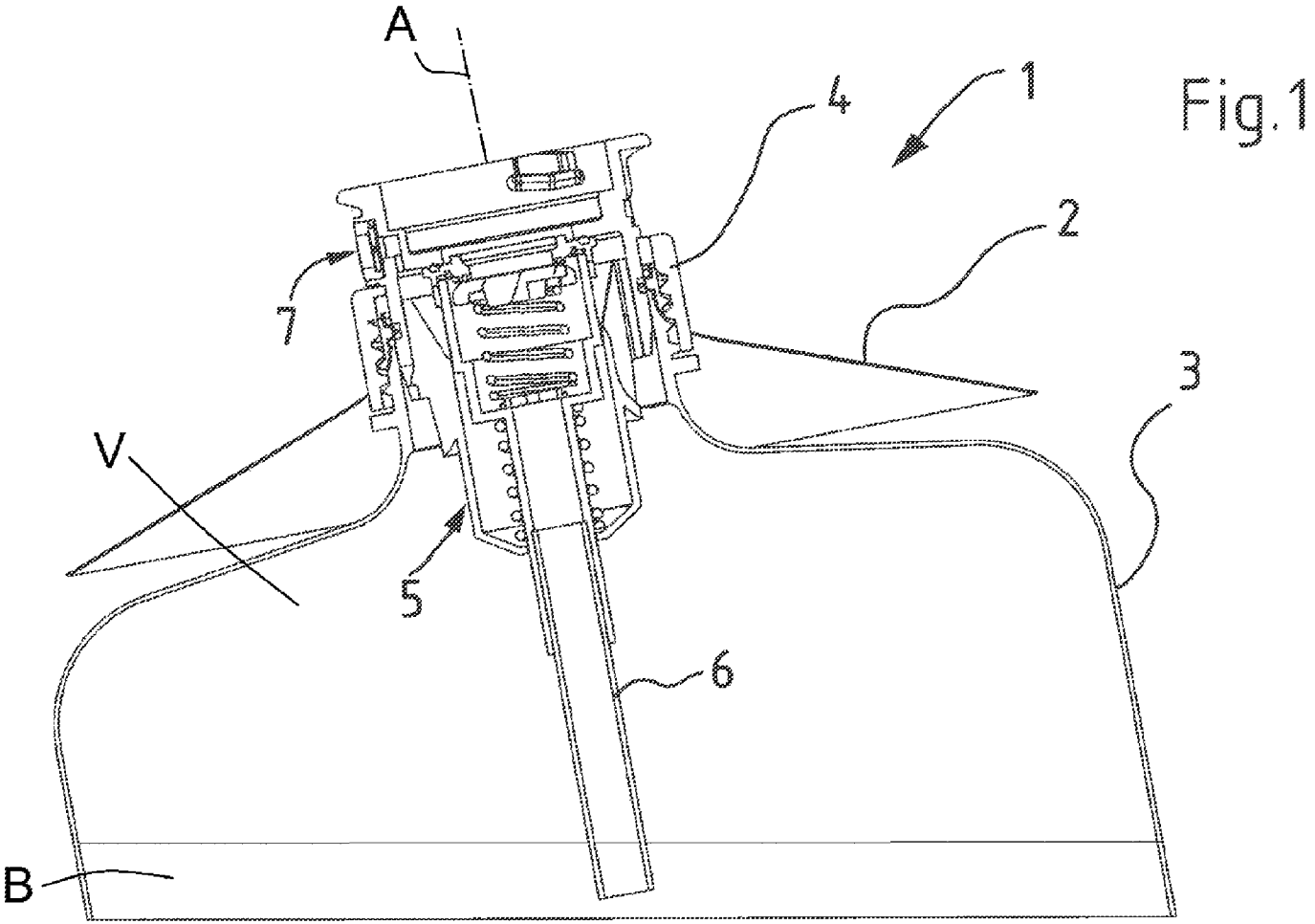
FIG. 1 is an axial section through an upper region of a container according to the invention.

As seen in the drawing a container 1 for holding or pressurized dispensing of beverages such as beer, soft drinks and sparkling wine has an outer sheet-steel jacket 2 (only shown partially) and a bladder 3 of thermoplastic film, in particular PET, therein. The bladder 3 holds a body of the liquid beverage being stored and dispensed by the container 1 as well as a volume of compressed gas, typically carbon dioxide, above it.

A fitting 5 generally centered on an axis A of the container 1 is secured to the mouth of the container 1 via an internally threaded adapter ring 4 and has a riser tube 6 projecting axially down into the bladder 3 and through which the liquid can rise from the body B. A connector for filling with a beverage in a brewery, for example, or a tap head for tapping by the consumer can be attached to the axial upper end of the fitting 5 as is known per se. The riser tube 6 forms a passage for the liquid to rise from body B to the fitting 5 and another passage 9 opens into the volume V of compressed $CO_2$ and can be supplied with more compressed gas if necessary by a dispensing apparatus connected to the fitting 5.

Figure 2:
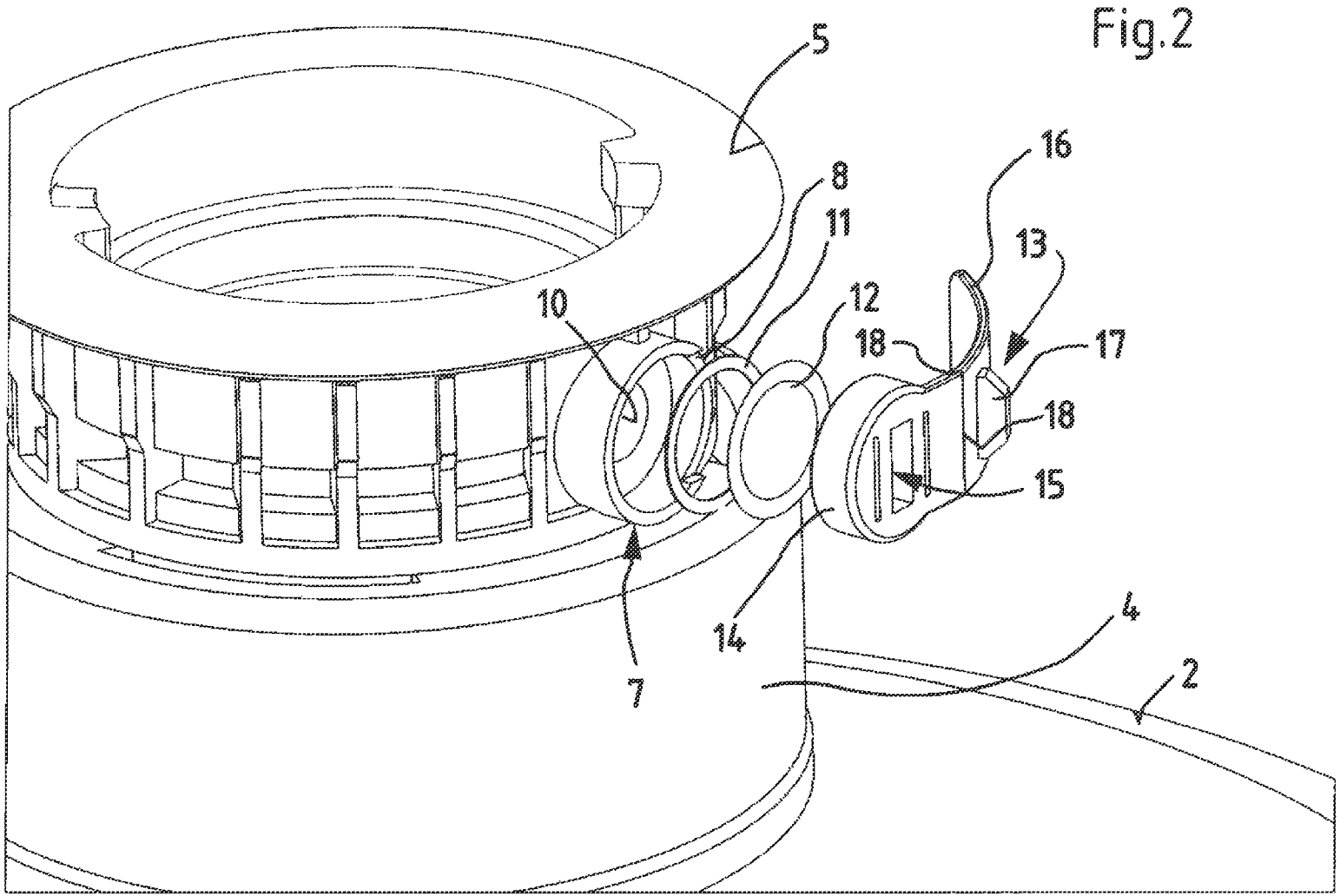
FIG. 2 is a large-scale exploded perspective view of a detail of the closure of the container.
Figure 3:
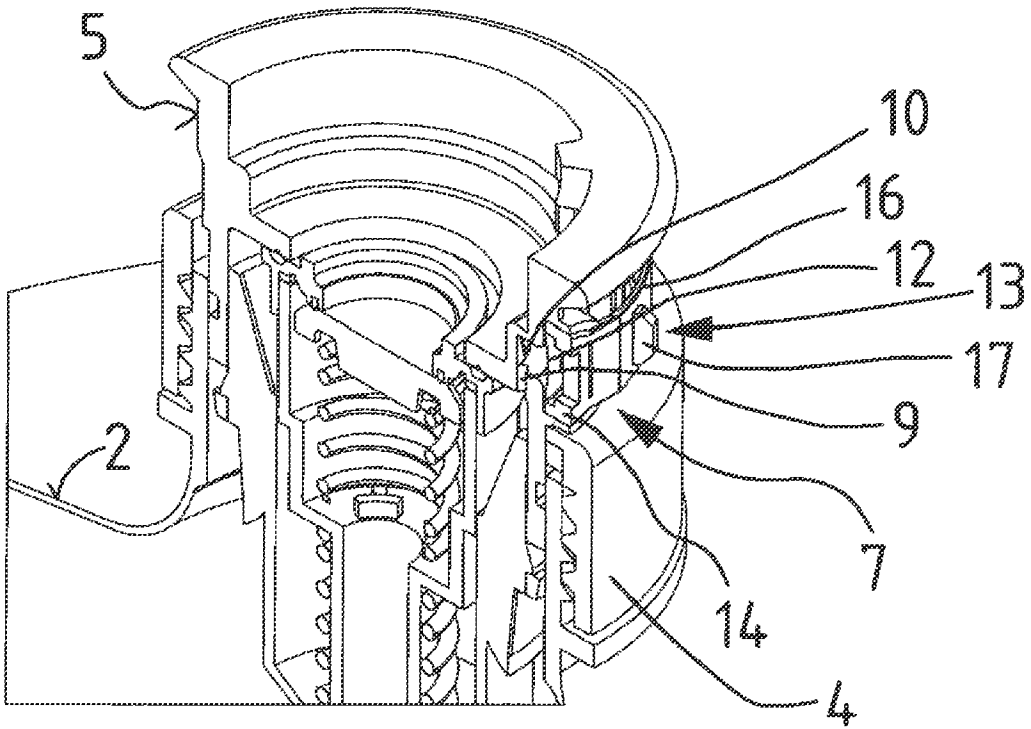
FIG. 3 is a large-scale perspective view in axial section through the closure.
Figure 4:
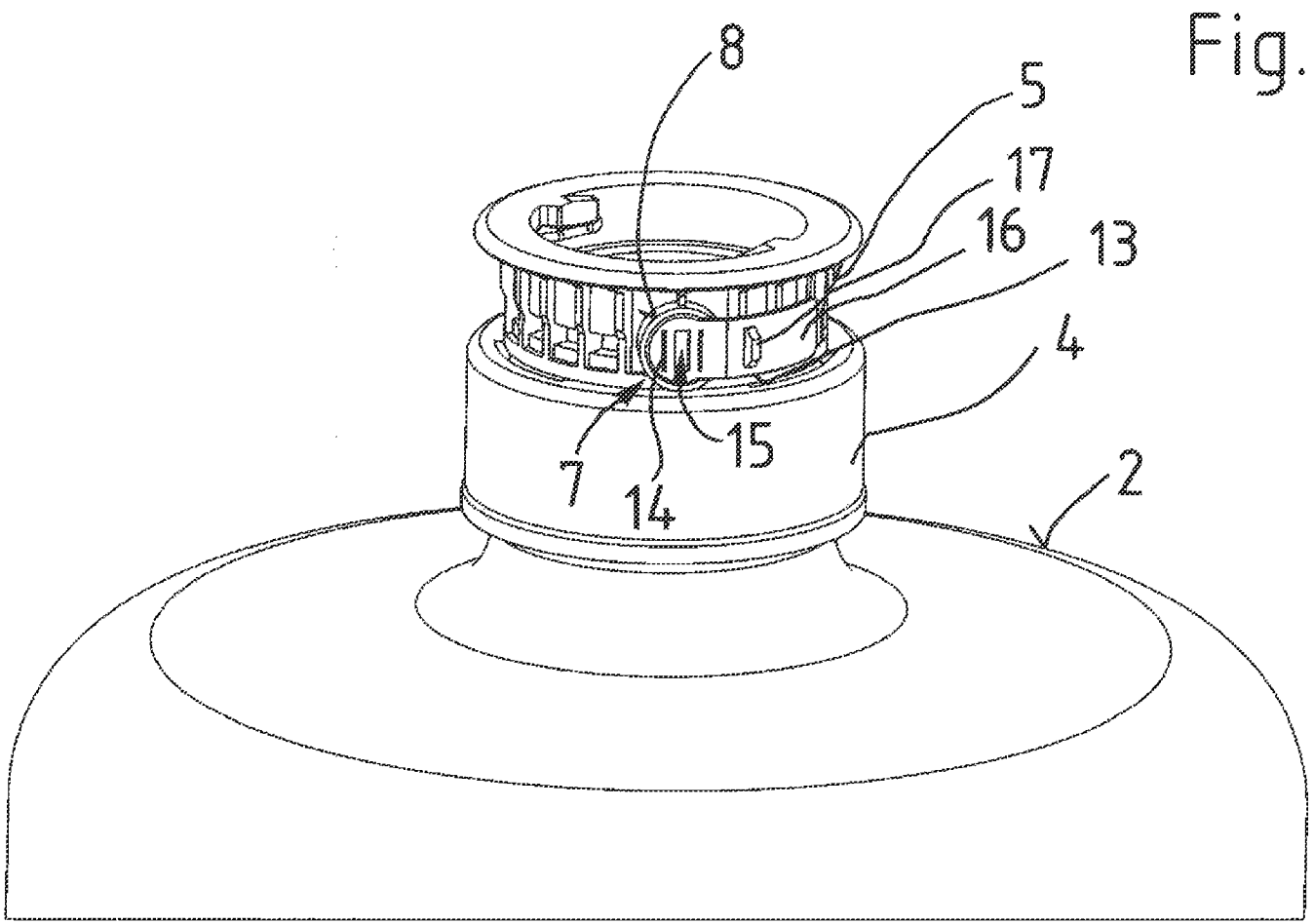
FIG. 4 is a perspective view from above of the closure.

As can be seen in FIGS. 2 through 4, the fitting 5 is provided with a safety vent 7. It comprises an annular radially outwardly projecting cylindrical collar 8 molded in one piece with the fitting 5 and forming a radially extending or open passage or hole 10 opening radially inwardly into the gas flow passage 9 of the fitting (FIG. 3). A flexible, semielastic, or otherwise frangible burst membrane 12 is fitted into the collar 8 with the interposition of a seal ring 11 so that it closes or blocks the hole 10 and is stretched and bursts if an internal overpressure occurs. It is typically constructed to burst at a maximum pressure of 25 bar, lower with a thin-walled container.

The burst membrane 12 that may for example be adhesively attached is held in the collar 8 by a perforation element 13 that has a cylindrically tubular head 14 press fitted into the collar 8 and fixed there by an unillustrated ring clamp, for example. The head 14 is formed with a point 15 directed radially toward but spaced radially outward from the burst membrane 12 (FIG. 3), and serving to ensure activation or opening of the safety vent 7 in that the bursting element 12 engages outward against it in the case of overpressure and is then torn or punctured at the latest when it strikes the point 15.

The perforation element 13 is furthermore provided with a circularly arcuate tab 16 that in the installed situation shown in FIG. 4 hugs the outer surface of the fitting 5 along its full length. The safety vent 7 is given an additional function by the perforation element 13, namely a targeted manual pressure relief by lifting or pulling away the tab 16 from the fitting 5 so that the point 15 is moved in the direction of the burst membrane 12, penetrating and destroying it. For easy handling when pulling off or pulling away the tab 16 it is provided with a release lug 17.

The tab 16 is formed between the release lug 17 and the molded head 14 with film hinge 18 running across its entire width 16, i.e. from the top downward. This film hinge 18 provides a visual indication of the original condition of the safety vent 7, in that it is immediately discernible by simple inspection whether the film hinge 18 has already been broken and thus a manual pressure relief has already been carried out.

We claim:

1. In combination with a container holding a pressurized beverage, a filling/drain fitting adapted for connection to a filling or dispensing device and having:

an annular and outwardly projecting collar formed unitarily with the fitting and forming a passage opening into the container;

a frangible burst membrane in the fitting and blocking the passage;

a perforation element formed unitarily with a cylindrical head snugly fittable into the collar;

an inwardly directed point on the head destructively engageable with the membrane in an overpressure condition inside the container; and a tab wrapped around an outer surface of the fitting and operable to force the point against the membrane on lifting of the tab outward and away from the fitting.

2. The combination defined in claim 1 wherein the tab has an outwardly projecting release lug.

3. The combination defined in claim 2 wherein the tab is formed between the release lug and the head with a crosswise film hinge.

4. The combination defined in claim 1 wherein the head is formed outward of the point with a throughgoing vent passage.

* * * * *